US005306018A

United States Patent [19]

Talbot

[11] Patent Number: 5,306,018

[45] Date of Patent: Apr. 26, 1994

[54] BAT FOR CATCHING GAMES

[76] Inventor: Marie L. C. Talbot, Black River, Mauritius, South Africa

[21] Appl. No.: 983,772

[22] Filed: Dec. 1, 1992

[30] Foreign Application Priority Data

Dec. 20, 1991 [ZA] South Africa ..... 91/10031

[51] Int. Cl.[5] ..... A63B 71/00

[52] U.S. Cl. ..... 273/327; 273/326

[58] Field of Search ..... 273/323, 324, 325, 326, 273/327, 328, 354, 401, 402, 412; 43/67

[56] References Cited

U.S. PATENT DOCUMENTS

| | | | |
|---|---|---|---|
| 2,369,145 | 2/1945 | Kent | 273/326 |
| 2,710,753 | 6/1955 | Lockwood | 273/326 |
| 3,467,381 | 9/1969 | Kreiss | 273/324 |
| 3,895,800 | 7/1975 | King | 273/354 |
| 3,992,008 | 11/1976 | Watkin | 273/326 |
| 4,829,701 | 5/1989 | ImBrogno | 43/67 |

FOREIGN PATENT DOCUMENTS

| | | | |
|---|---|---|---|
| 169479 | 8/1906 | Fed. Rep. of Germany | 273/324 |
| 407105 | 12/1924 | Fed. Rep. of Germany | 273/323 |
| 417151 | 8/1925 | Fed. Rep. of Germany | 273/327 |
| 395936 | 3/1909 | France | 273/326 |
| 567117 | 2/1924 | France | 273/323 |
| 2445728 | 9/1980 | France | 273/327 |
| 891047 | 3/1962 | United Kingdom | 273/326 |

*Primary Examiner*—Mark S. Graham

*Attorney, Agent, or Firm*—Young & Thompson

[57] ABSTRACT

A bat or racquet for a new ball catching game has a handle and a head, the head having an orifice through which the ball can pass and also having a net-like material against which the caught ball strikes. The net-like material is attached to a pair of opposed elements which are slidable in a frame inside the bat. The opposed elements are spring-loaded with the springs being arranged to be off-centre for the elements to snap between a first ball-receiving condition, and a second ball-capturing condition.

8 Claims, 3 Drawing Sheets

BAT FOR CATCHING GAMES

BACKGROUND OF THE INVENTION

1. Field of the Invention

This invention relates to a bat for a catching game.

2. Description of the Related Art

There are many games which involve the catching of a ball with a bat, racquet or the like and the ball is then thrown from the bat. Such games include pelota and lacrosse.

Beach tennis bats are also known, but it is an object of the present invention to provide a new game which can be played anywhere and which gives young and old excellent enjoyment and exercise.

SUMMARY OF THE INVENTION

According to the invention, a bat, racquet or the like includes a handle and a head, the head including an orifice through which a ball may pass, the orifice including flexible ball catching material, the catching material being included between a pair of elements slidable in a frame between a first position in which the ball passes therebetween and a second position to which the elements are moved by virtue of the catching material being acted upon by the entering ball, the elements being adapted to retain the ball in the second position.

In a preferred form of the invention, the elements are spring-loaded to bias them in each of the two positions.

In one form of the invention, leaf springs are provided which act bi-directionally corresponding to the position of the elements, the change of direction occuring intermediate the first and second positions. For example, the springs may have two off-centre positions so that the spring action is reversable. Alternatively, the spring action may be directed to a position which is off-centre having regard to the end attachments or bearings of the springs.

The elements are preferably curved at their insides—i.e. The sides which receive the ball.

The combined action, caused by the entrance of the ball against the catching material and the spring action, causes the elements to snap from the first to the second position and the ball is held captive until forced outwardly by thumb action, when the elements are forced apart against the spring action and they snap back to the first position.

The frame and elements may be contained between opposed bat formations and the assembly screwed together.

BRIEF DESCRIPTION OF THE DRAWINGS

An embodiment of the invention is described below with reference to the accompanying drawings in which.

DETAILED DESCRIPTION OF THE PREFERRED EMBODIMENT

Figure 1:
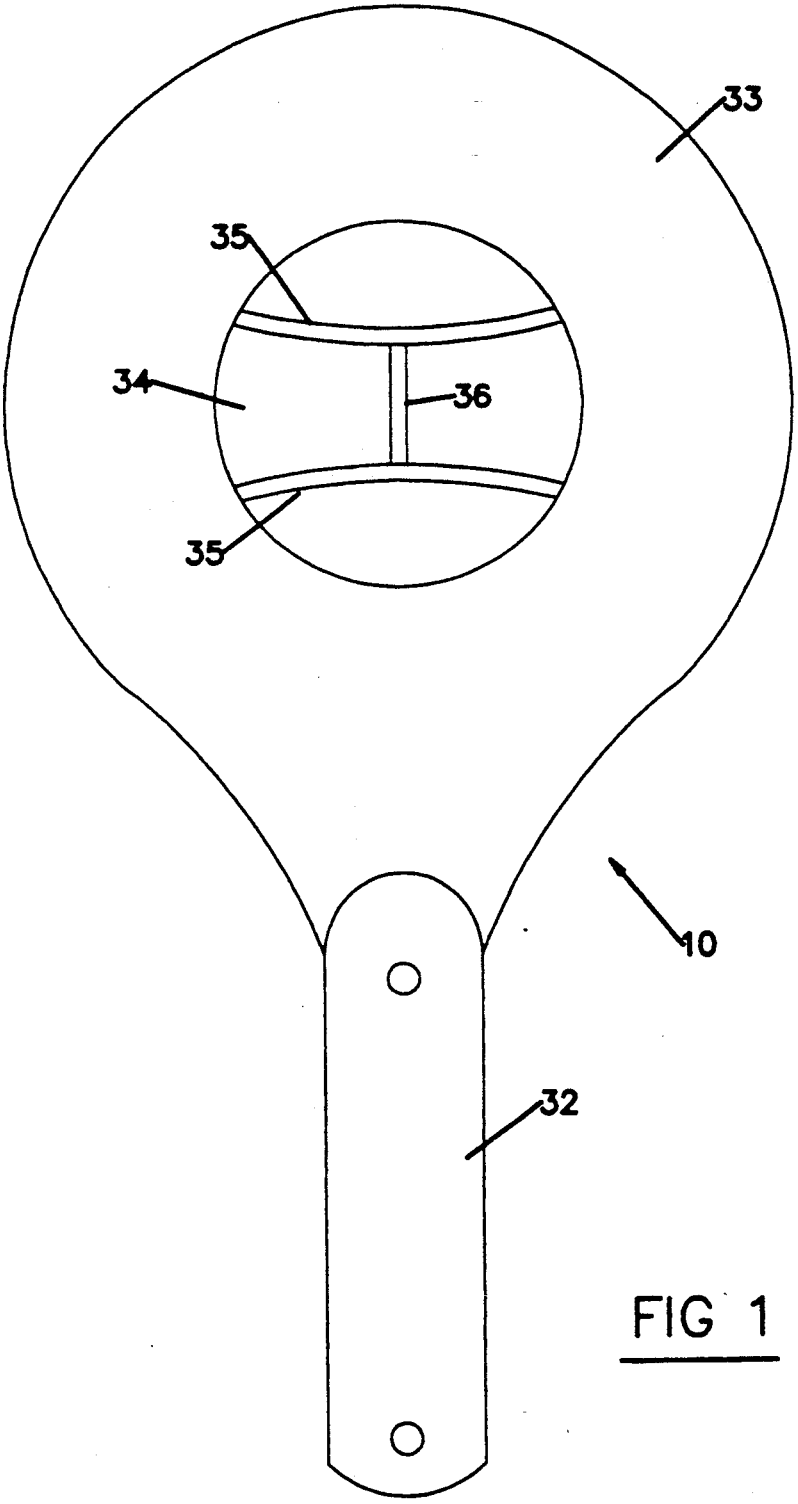
FIG. 1 is a front view of a bat according to the invention.

In FIG. 1, a bat 10 has a handle 32 and head 33, the latter having an orifice 34 which is large enough comfortably to receive a ball.

The orifice 34 is obturated by a pair of lines 35 with a cross line 36.

Figure 2:
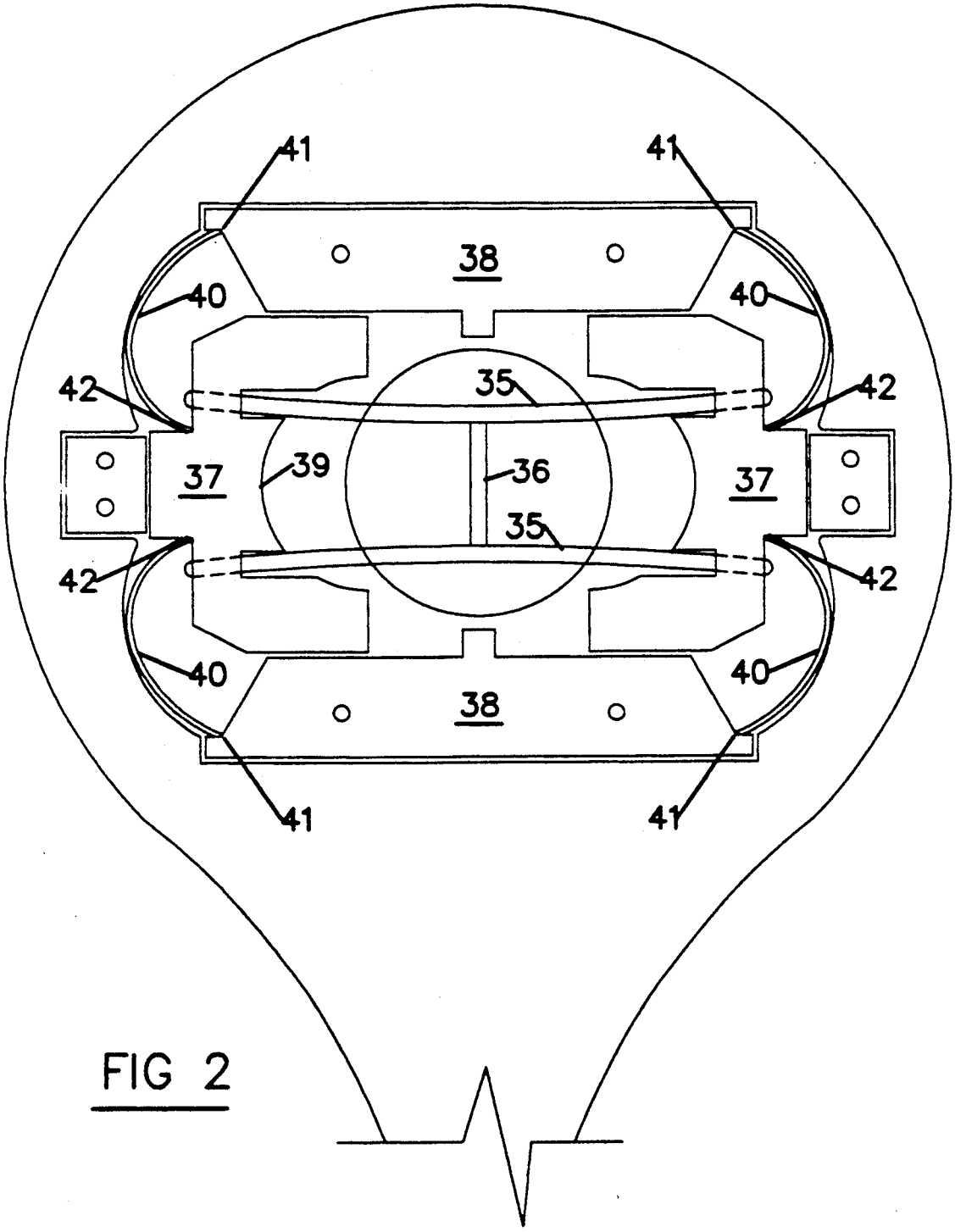
FIGS. 2 and 3 are similar views with one of the bat formations removed to illustrate the internal mechanism of the catching arrangement.
Figure 3:
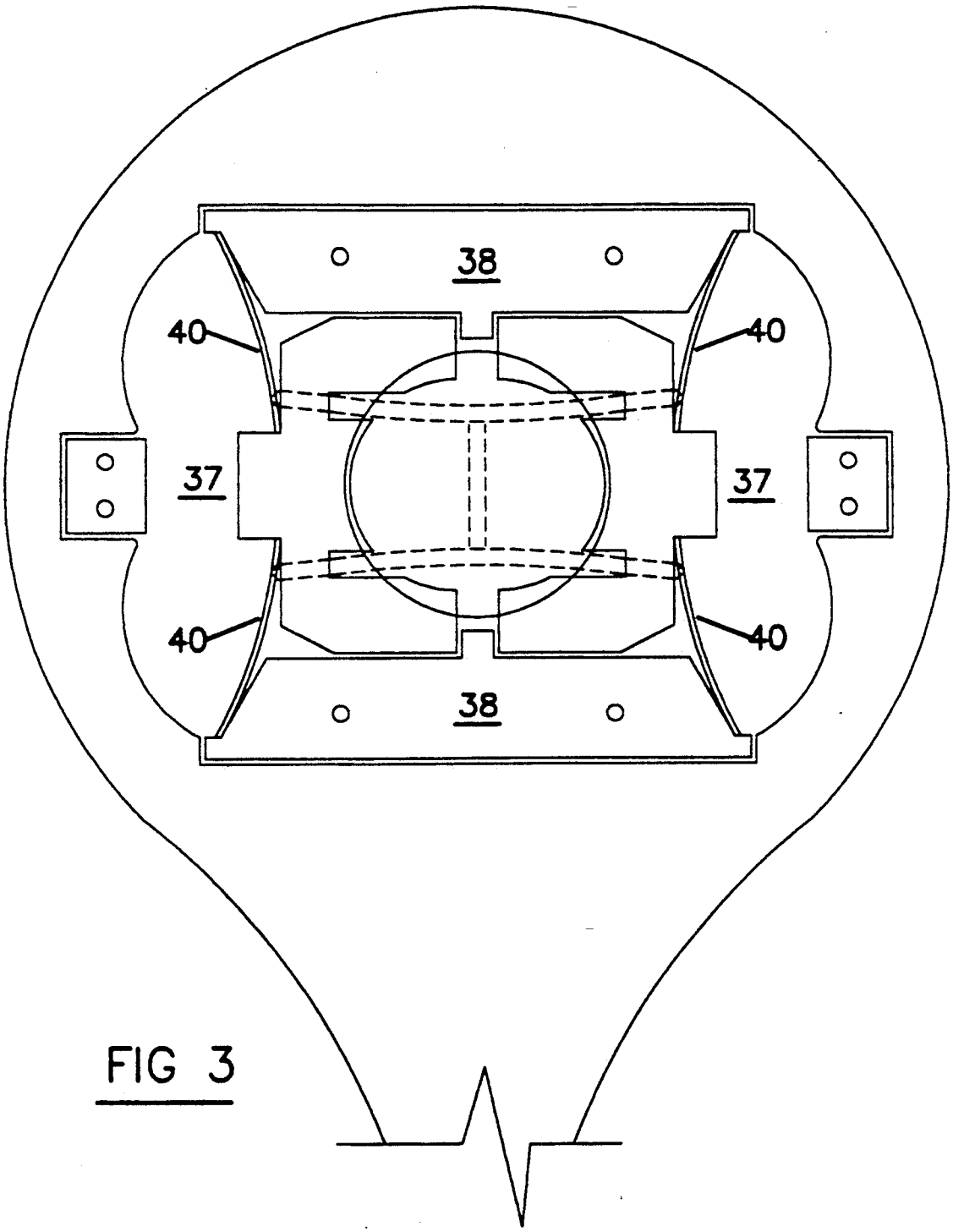

Referring to FIGS. 2 and 3, the lines 35 are attached to opposing elements 37 which are slidable in frames 38.

The opposing elements 37 have curved interior sides 39 and these sides 39 are spaced even further apart than the diameter of the orifice 34. In a first position as shown in FIG. 2, the leaf springs 40 act between points 41 and 42 and due to the curvature thereof, the elements 37 are maintained in the open position of FIG. 2 and the opposing lines 35 are maintained in a taut condition.

A flying ball, on entering the orifice 34, will strike the lines 35 with a force sufficient to cause the opposing elements 37 to move rapidly towards each other, duly assisted by the reverse spring action which will be imparted and the ball will be caught by resulting snap action, and a situation as shown in FIG. 3 will result.

When it is required to free the ball, the spring leafs 40 are merely pushed in the opposite direction, by which action the opposing elements 37 are pushed away from each other sufficiently for the spring action to reverse itself once more so that the leaf springs 40 snap again to the first position as shown in FIG. 2.

The leaf springs 40 may have notches cut out into their ends and these notches engage with complemental formations at points 41 and 42.

The foregoing preferred embodiment is considered to be illustrative only. Different modifications and changes may readily occur to other persons after reading this disclosure. Thus, the disclosed invention is not limited to the exact construction shown and described above, but rather is encompassed within the letter and spirit of the following claims.

I claim:

1. A racquet with a handle and a head, the head including an orifice adapted so that a ball may pass therethrough, the orifice comprising:

flexible ball-catching material, the catching material being included between a pair of elements slidable in a frame between a first position in which the ball passes therebetween land a second position to which the elements are moved by virtue of the catching material being acted upon by the entering ball, the elements being adapted to retain the ball in the second position.

2. The racquet according to claim 1 in which the elements are spring-loaded to bias them in each of the two positions.

3. The racquet according to claim 2 further comprising:

leaf springs that act bi-directionally, corresponding to the position of the elements, whereby any change of direction occurs intermediate the first and second positions.

4. The racquet according to claim 3 in which the leaf springs have two off-centre positions for reversible spring action.

5. The racquet according to claim 3 in which spring action is directed to a position which is off centre with regard to end attachments or bearing points of the leaf springs.

6. The racquet according to claim 1 in which the elements have curved interior sides.

7. The racquet according to claim 2 in which combined action, caused by entrance of the ball against the catching material and spring action, causes the elements to snap from the first to the second position and the ball is held captive until forced outwardly by thumb action, when the elements are forced apart against the spring action by which the elements snap back to the first position.

8. The racquet according to claim 1 in which the frame and the elements are contained between opposed bat formations.

* * * * *